US005678730A

United States Patent [19]

Fabek et al.

[11] Patent Number: 5,678,730

[45] Date of Patent: Oct. 21, 1997

[54] WRIST WEB DISPENSER

[76] Inventors: John Fabek, 361 Lynn Pl., Oakville, Ontario, Canada, L6H 2C5; Kimberley Runions, 40 Harding Blvd. West Unit 704, Richmond Hill, Ontario, Canada, L4C 9S5

[21] Appl. No.: 562,705

[22] Filed: Apr. 10, 1996

[51] Int. Cl.[6] ..... B67D 5/00

[52] U.S. Cl. ..... 222/78; 222/175; 222/402.15; 472/52; 2/160

[58] Field of Search ..... 222/78, 79, 175, 222/192, 402.1, 402.15; 239/154, 529; 472/51, 52; 2/160, 161.1

[56] References Cited

U.S. PATENT DOCUMENTS

| | | | |
|---|---|---|---|
| 4,037,790 | 7/1977 | Reiser et al. | 222/175 X |
| 4,228,548 | 10/1980 | Cohen | 2/161.1 |
| 4,463,879 | 8/1984 | Des Voignes | 222/175 |
| 4,768,681 | 9/1988 | Dean et al. | 222/175 X |
| 4,903,864 | 2/1990 | Sirhan | 222/175 X |
| 4,997,110 | 3/1991 | Swenson | 222/175 |
| 5,072,856 | 12/1991 | Kimble | 222/175 X |
| 5,088,121 | 2/1992 | Wallace | 222/175 X |
| 5,158,208 | 10/1992 | Wilson | 222/175 X |
| 5,303,847 | 4/1994 | Cottone | 222/175 X |
| 5,345,368 | 9/1994 | Huff | 2/160 X |
| 5,484,085 | 1/1996 | Bennett | 222/175 X |
| 5,503,304 | 4/1996 | Keller et al. | 222/175 |
| 5,538,164 | 7/1996 | Rivas | 222/175 X |

*Primary Examiner*—Andres Kashnikow
*Assistant Examiner*—Kenneth Bomberg

[57] ABSTRACT

An amusement device for selectively discharging a pressurized medium from a user's palm, in effect, enabling a person to mimic Spider Man. In its broadest context, the present invention includes a hand strap which is adapted to be positioned about the palm area of a user, a canister holder which is connected to the hand strap, and a canister of a stringy web like material. With the present invention a user can dispense the web like material from their palm.

4 Claims, 3 Drawing Sheets

WRIST WEB DISPENSER

BACKGROUND OF THE INVENTION

1. Field of the Invention

The present invention relates to wrist web dispenser and more particularly pertains to a device for dispensing a web like material.

2. Description of the Prior Art

The use of water shooters is known in the prior art. More specifically, water shooters heretofore devised and utilized for the purpose of spraying water are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,997,110 to Swenson a concealable water shooter; U.S. Pat. No. 5,158,208 to Wilson discloses a water cannon apparatus; U.S. Pat. No. 5,303,847 to Cottone discloses a toy dispersing water from fingertip sheath; U.S. Pat. No. 4,903,864 to Sirhan discloses a glove amusement device; U.S. Pat. No. 4,768,681 to Dean et al., discloses a fluid action toy; and lastly, U.S. Pat. No. 4,037,790 to Reiser et al discloses a water glove.

In this respect, the wrist web dispenser according to the present invention substantially departs from the conventional concepts and designs of the prior art, and in doing so provides an apparatus primarily developed for the purpose of dispensing a web like material.

Therefore, it can be appreciated that there exists a continuing need for new and improved wrist web dispenser which can be used for dispensing a web. In this regard, the present invention substantially fulfills this need.

SUMMARY OF THE INVENTION

In view of the foregoing disadvantages inherent in the known types of water shooters now present in the prior art, the present invention provides an improved wrist web dispenser. As such, the general purpose of the present invention, which will be described subsequently in greater detail, is to provide a new and improved wrist web dispenser and method which has all the advantages of the prior art and none of the disadvantages.

To attain this, the present invention essentially comprises a device for selectively discharging a pressurized medium from a user's palm. The device includes a nylon hand strap having a first end, a second end, a forward edge, a rearward edge, an upper surface for engaging a user's palm, and a lower surface, and a thumb receiving aperture formed adjacent the first end. First and second hook and pile fasteners are formed intermediate the thumb receiving aperture and the first end upon the lower surface of the hand strap. Likewise, third and fourth hook and pile fasteners are formed approximate the second end and upon the upper surface of the hand strap. These the third and fourth hook and pile fasteners are adapted for engagement with the first and second hook and pile fasteners when the hand strap is positioned around the hand of a user. A nylon canister strap, which has a first end and a second end and an intermediate extent therebetween, is positioned such that the intermediate extent of the canister strap is secured to the lower surface of the hand strap intermediate the first and second ends. A fifth hook and pile fastener is secured to the first end of the canister strap, while a sixth hook and pile fastener is secured to the second end of the canister strap. The present invention also includes a cylindrical canister which has a discharge end, and a lever integral with the discharge end of the canister. This lever functions to selectively discharge the contents of the canister while the canister is positioned within the canister strap with the fifth and sixth hook and pile fasteners secured together. The medium which is positioned within the cylindrical canister is adapted to be dispensed therefrom. This medium is substantially solid and characterized by dispensing in a continuous web like string.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved wrist web dispenser which have all the advantages of the prior art water shooters and none of the disadvantages.

It is another object of the present invention to provide new and improved wrist web dispenser which may be easily and efficiently manufactured and marketed.

It is further object of the present invention to provide new and improved wrist web dispenser which are of durable and reliable constructions.

An even further object of the present invention is to provide new and improved wrist web dispenser which are susceptible of a low cost of manufacture with regard to both materials and labor, and which accordingly are then susceptible of low prices of sale to the consuming public, thereby making such wrist web dispenser economically available to the buying public.

Still yet another object of the present invention is to provide new and improved wrist web dispenser which provide in the apparatuses and methods of the prior art some of the advantages thereof, while simultaneously overcoming some of the disadvantages normally associated therewith.

Even still another object of the present invention is to provide a device for shooting a web like material which can be secured to the wrist of a user.

Lastly, it is an object of the present invention to provide new and improved amusement device for selectively discharging a pressurized medium from a user's palm, in effect, enabling a person to mimic Spider Man. In its broadest context, the present invention includes a hand strap which is adapted to be positioned about the palm area of a user, a canister holder which is connected to the hand strap, and a canister of a stringy web like material. With the present invention a user can dispense the web like material from their palm.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
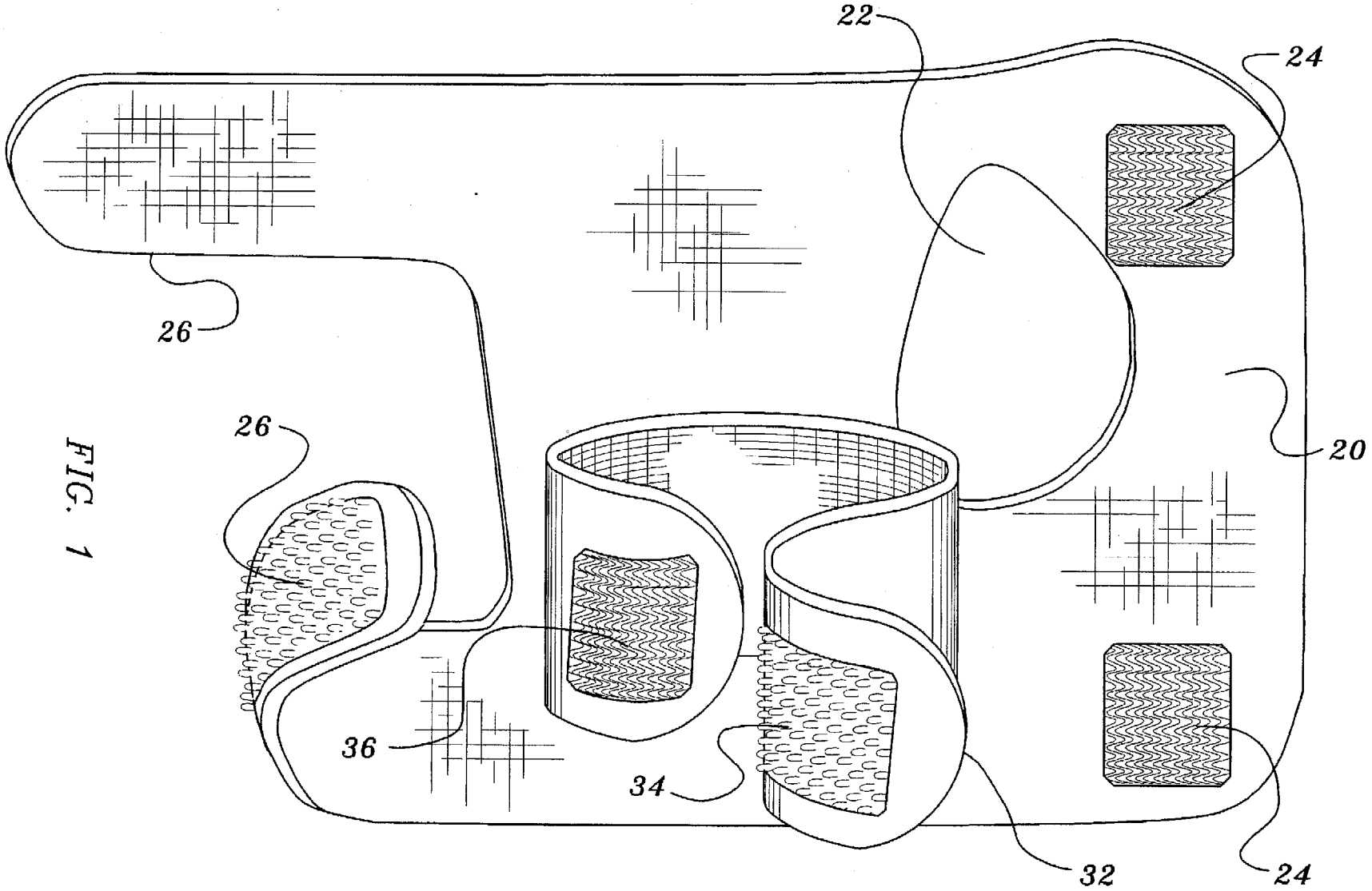
FIG. 1 is a plan view of the preferred embodiment of the wrist web dispenser constructed in accordance with the principles of the present invention.
Figure 2:
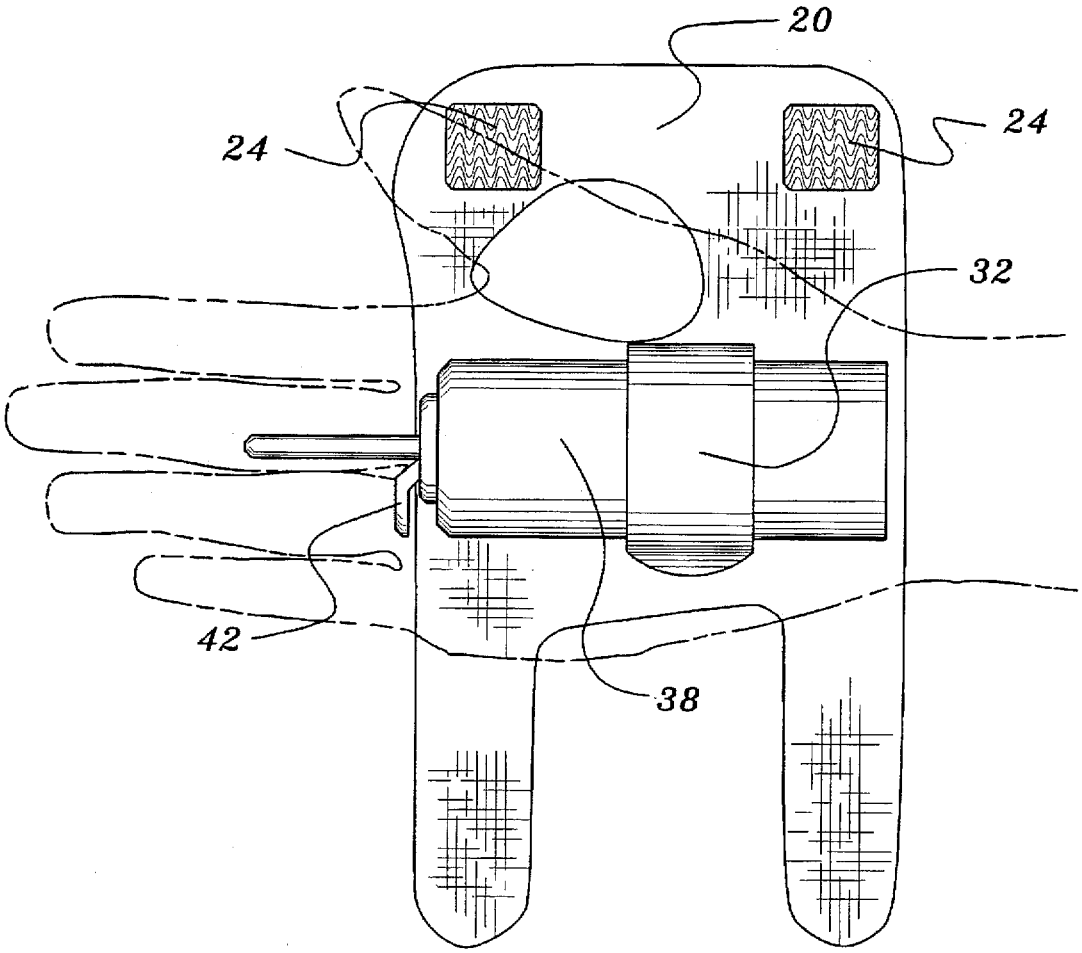
FIG. 2 is a plan view of the device being placed over the hand of the user.
Figure 3:
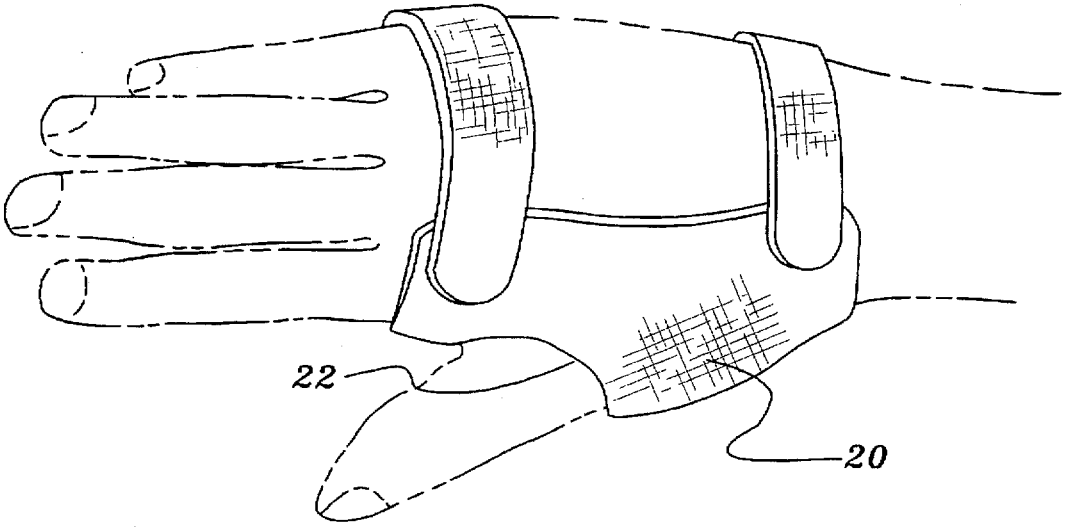
FIG. 3 is a view of the device upon the hand of a user.
Figure 4:
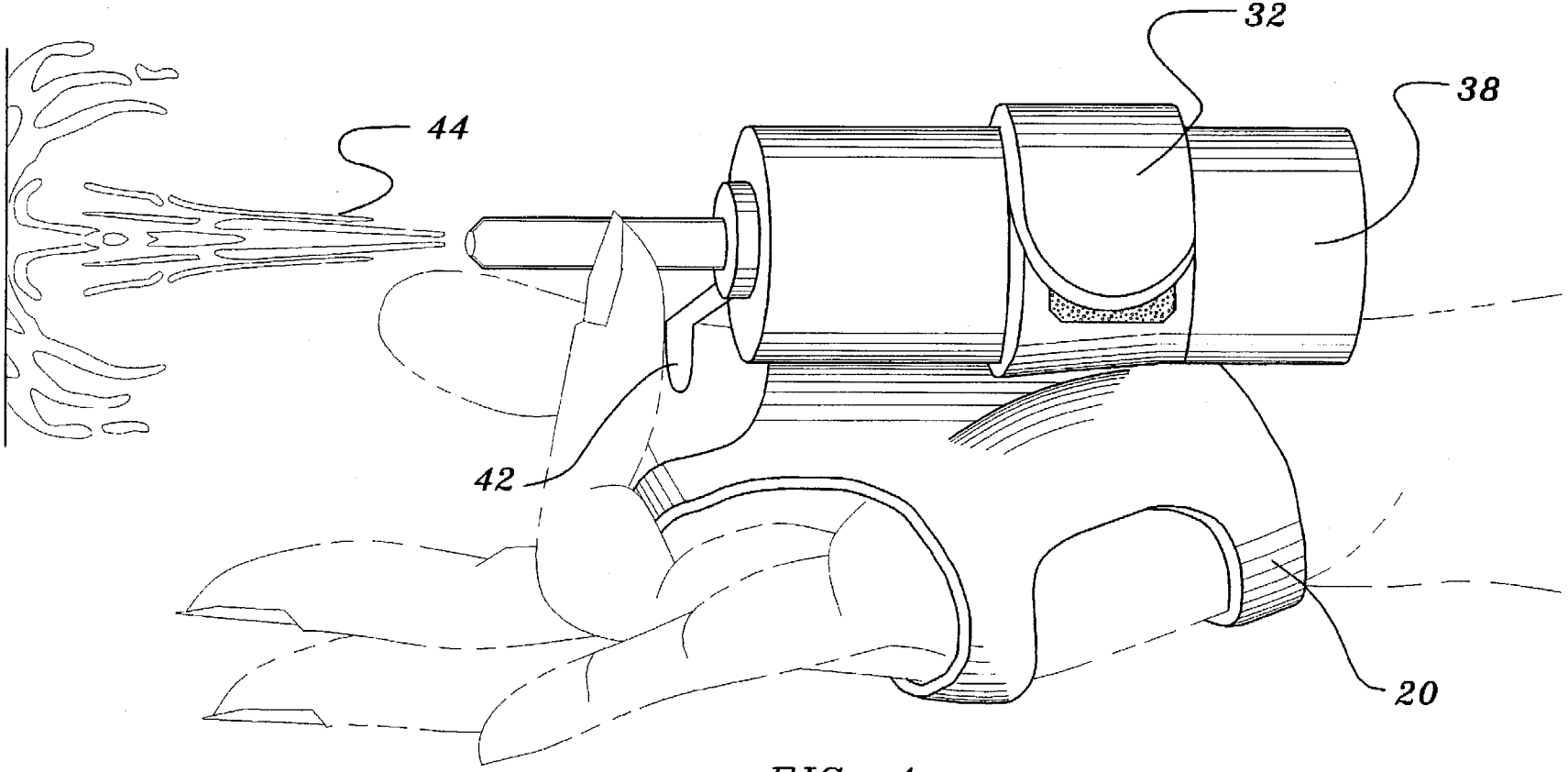
FIG. 4 is a view of the device upon the hand of the user and in operation.

With reference now to the drawings, and in particular to FIG. 1 thereof, the preferred embodiment of the new and improved wrist web dispenser embodying the principles and concepts of the present invention and generally designated by the reference numeral 10 will be described.

The present invention relates to an amusement device for selectively discharging a pressurized medium from a user's palm, in effect, enabling a person to mimic Spider Man. In its broadest context, the present invention includes a hand strap which is adapted to be positioned about the palm area of a user, a canister holder which is connected to the hand strap, and a canister of a stringy web like material. With the present invention a user can dispense the web like material from their palm. The details of the present invention, as well as its manner of operation, will be described in greater detail hereinafter.

The hand strap 20 is defined by a first end, a second end, a forward edge, a rearward edge, an upper surface, and a lower surface. In the preferred embodiment, the entire hand strap 20 is constructed from a soft nylon material. However, other soft resilient materials will suffice. The upper surface of the strap is adapted for engagement with the palm of the user, while the lower surface is adapted to receive the canister 38. In order to better facilitate placement of the strap upon the hand of a user, a thumb receiving aperture 22 is formed adjacent the first end. The second end of the hand strap 20 can take the form of two discrete lengths.

Velcro™ fasteners, or hook and pile fasteners, are the preferred securing means for the hand strap 20. In the preferred embodiment, two sets of hook and pile fasteners are employed. First and second hook and pile fasteners 24 are positioned adjacent the first end of the strap. More specifically, the first and second fasteners are positioned intermediate the thumb receiving aperture 22 and the first end upon the lower surface of the hand strap 20. The opposite set of fasteners, or the third and fourth hook and pile fasteners 26 are formed approximate the second end and upon the upper surface of the hand strap 20. As indicated above, the second end of the hand strap 20 can take the form of two discrete straps. In this embodiment, the third and fourth hook and pile fasteners 26 are positioned at the ends of the discrete straps. This opposite set of hook and pile fasteners are adapted for engagement with the first and second hook and pile fasteners 24 when the hand strap 20 is positioned around the hand of a use.

The canister strap 32 is defined by a first end, a second end and an intermediate extent therebetween. This intermediate extent of the canister strap 32 is secured intermediate the first and second ends of the hand strap 20 upon the lower surface. This securement can be achieved in a conventional manner, as by stitching or gluing. As with the hand strap 20, the preferred material for the canister strap 32 is nylon. Furthermore, hook and pile fasteners are employed in securing a canister 38 to the canister strap 32. More specifically, a fifth hook and pile fastener 34 is secured to the first end of the canister strap 32, while a sixth hook and pile fastener 36 is secured to the second end of the canister strap 32. These hook and pile fasteners are secured to one another when a canister 38 is positioned within the strap.

In the preferred embodiment the canister 38 is cylindrical in shape. Furthermore, the canister 38 has a discharge end and a lever 42 which is integral with the discharge end of the canister 38. This lever 42 functions to selectively discharge the contents of the canister 38. As pointed out earlier, the canister 38 can be positioned and secured within the canister strap 32 with the fifth and sixth hook and pile fasteners secured together. The medium 44 positioned within the cylindrical canister 38 is adapted to be dispensed therefrom by the manipulation of the lever 42. This medium 44 is substantially solid in form. Furthermore, this medium 44 is characterized by dispensing in a continuous web like string, thus giving a Spider Man effect. The canister 38 and its contents could be commercially available products such as Silly String™ or Funstreamers™. However, any pressurized or propellant type canister of material which is substantially solid and dispenses in a continuous string will suffice.

In use, the nylon hand strap is secured to the hand of the user. To achieve this, the user inserts his thumb into the thumb aperture of the hand strap. The presence of the thumb aperture makes the hand strap usable with only the right or left hand. If the thumb aperture is adjacent the first end of the strap, as has been described and pictured, it is a right handed device. The thumb aperture can be formed adjacent the second end if one wishes a left handed device. After insertion of the thumb, the two opposite ends of the hand strap are brought about to the top side of the hand. The first and second hook and pile fasteners are then secured to the second and third hook and pile fasteners. At this point, the canister strap is positioned at the center portion of the users palm. The canister of the medium to be dispensed is then secured within the canister strap. This is achieved by placing the canister within the strap and securing the opposite ends via the hook and pile fasteners. As such, a user can manipulate the lever of the canister with the digits of the hand upon which the device is worn.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A device for selectively discharging a pressurized medium from a user's palm, the device comprising in combination:

a nylon hand strap having a first end, a second end, a forward edge, a rearward edge, an upper surface for engaging a user's palm, and a lower surface, a thumb receiving aperture formed adjacent the first end;

first and second hook and pile fasteners formed intermediate the thumb receiving aperture and the first end upon the lower surface of the hand strap;

third and fourth hook and pile fasteners formed approximate the second end and upon the upper surface of the hand strap, the third and fourth hook and pile fasteners adapted for engagement with the first and second hook and pile fasteners when the hand strap is positioned around the hand of a user;

a nylon canister strap having a first end and a second end and an intermediate extent therebetween, the intermediate extent of the canister strap secured to the lower surface of the hand strap intermediate the first and second ends, a fifth hook and pile fastener secured to the first end of the canister strap, a sixth hook and pile fastener secured to the second end of the canister strap;

a cylindrical canister having a discharge end, a lever integral with the discharge end of the canister, the lever functioning to selectively discharge the contents of the canister, the canister positioned within the canister strap with the fifth and sixth hook and pile fasteners secured together;

a medium positioned within the cylindrical canister and adapted to be dispensed therefrom, the medium being substantially solid and characterized by dispensing in a continuous web like string.

2. A device for selectively discharging a pressurized medium from a user's palm, the device comprising in combination:

a hand strap having a first end, a second end, a forward edge, a rearward edge, an upper surface for engaging a user's palm, and a lower surface;

first and second securing means formed approximate the first end upon the lower surface of the hand strap;

third and fourth securing means formed approximate the second end and upon the upper surface of the hand strap, the third and fourth securing means adapted for engagement with the first and second securing means when the hand strap is positioned around the hand of a user;

a canister strap having a first end and a second end and an intermediate extent therebetween, the intermediate extent of the canister strap secured to the lower surface of the hand strap intermediate the first and second ends, a fifth securing means secured to the first end of the canister strap, a sixth securing means secured to the second end of the canister strap;

a cylindrical canister having a discharge end, a lever integral with the discharge end of the canister, the lever functioning to selectively discharge the contents of the canister, the canister positioned within the canister strap with the fifth and sixth securing means secured together;

a medium positioned within the cylindrical canister and adapted to be dispensed therefrom.

3. The device as described in claim 2 wherein:

the first and second securing means are hook and pile fasteners;

the second and third securing means are hook and pile fasteners;

the fifth and sixth securing means are hook and pile fasteners.

4. The device as described in claim 2 wherein:

the medium positioned within the cylindrical canister is substantially solid and characterized by dispensing in a continuous web like string.

* * * * *